United States Patent [19]

Willemsens

[11] 4,313,980

[45] Feb. 2, 1982

[54] METHOD AND DEVICE FOR SLIDE HOPPER MULTILAYER COATING

[75] Inventor: Karel S. Willemsens, Berchem, Belgium

[73] Assignee: Agfa-Gevaert N.V., Mortsel, Belgium

[21] Appl. No.: 140,732

[22] Filed: Apr. 16, 1980

[30] Foreign Application Priority Data

Apr. 19, 1979 [GB] United Kingdom ..... 13627/79

[51] Int. Cl.[3] ..... B05D 1/30

[52] U.S. Cl. ..... 427/402; 118/325; 118/DIG. 4; 427/411; 427/420

[58] Field of Search ..... 118/324, 325, DIG. 4, 118/407, 412, 376; 427/420, 401, 402, 411, 445

[56] References Cited

U.S. PATENT DOCUMENTS 3,508,947 4/1970 Hughes ..... 118/325 X
3,920,862 11/1975 Damschroder et al. ..... 427/420 X
3,968,772 7/1976 Greiller ..... 118/325
4,019,906 4/1977 Ridley ..... 427/420
4,113,903 9/1978 Choinski ..... 427/420
4,233,346 11/1980 Kerkhofs ..... 427/345

FOREIGN PATENT DOCUMENTS 3860 9/1979 European Pat. Off. ..... 427/420

*Primary Examiner*—Shrive P. Beck
*Attorney, Agent, or Firm*—William J. Daniel

[57] ABSTRACT

A method and device for slide hopper multilayer coating, that aims to reduce or prevent the formation of beaded edges of the layers of coating composition as the layers slide down along the slide surfaces of the slide hopper coating head and as they are applied to a moving web material, wherein at least the upper one of the different layers formed by the slide hopper coater is coated at a width ($l_2$) that exceeds the width ($l_1$) of at least one other lower layer formed by the hopper.

10 Claims, 5 Drawing Figures

METHOD AND DEVICE FOR SLIDE HOPPER MULTILAYER COATING

The present invention relates to a method and a device for slide hopper multilayer coating. The invention relates in particular to the reduction or the prevention of the formation of beaded edges on the layers of coating composition as said layers slide down along the slide surface of the slide hopper coating head and are applied to a moving web material.

In general, in the manufacture of coated webs, films and the like, the production of a continuous structure of standard and uniform thickness is desirable for optimum utilization of facilities and material. However when one or more coatings are applied in a continuous manner to a web by means of a slide hopper, excess coating material is deposited at the margins of the coated area forming so-called edge beads. And sometimes there is a deficiency of coating material at zones contiguous to the edge bead. In consequence the amount of coated web of acceptable quality which is produced for a given consumption of coating material is less than it should be.

Many coating compositions used in the production of coated webs, for example the coating compositions employed in the manufacture of photographic light-sensitive film material, are relatively expensive and are recoverable, if at all, from defectively coated portions of the web only by use of relatively complicated and expensive procedures.

Furthermore, the variations in coating thickness due to edge bead formation, have adverse consequences when the coatings are required to be chilled and dried within exact parameters of time and/or temperature in order to achieve optimum product properties. For example, in the production of photographic film, the edge bead areas of the coating, having a greater thickness than the central portion of the coating width, require a relatively long drying period and/or higher drying temperature gradients. In continuous coating processes therefore, the coating defects may make it necessary to employ more complex chilling equipment and/or drying equipment and/or to adopt lower coating speeds than would otherwise be required. If increased drying capacity is used in order to insure that the edge beads are dried, this in general means that the central portion of the coating width is subjected to excessive heating which may damage the product. In the case of light-sensitive photographic material the excessive heating is liable to cause changes in the sensitometric properties.

Yet another consequence of edge bead formation is that if the coated web is wound up to form a roll the successive convolutions are unstably supported one on another due to the beaded edges, with the result that during further handling of the roll for purposes of transport, application of other coatings, inspection for defects, slitting, etc., the convolutions are liable to slide axially relative to each other. In the case of light-sensitive material this telescoping of the roll is liable to damage the entire roll and make it worthless for further use.

It is known in the coating art to employ mechanical devices, such as doctor blades, scrapers, calender rollers and the like in forming a web coating. These devices have not however obviated the problem of edge bead formation when forming a plurality of relatively thin and fragile coating layers on the web such as is necessary in the manufacturing of photographic material.

It has been proposed to counter edge bead formation by creating a vacuum at the marginal zones of a freshly coated web, thereby to suck off a portion of the material in the edge beads and it has also been proposed to supplement the action of such suction forces by directing a jet of water onto the marginal zones. But neither of these proposals has proved satisfactory.

It is therefore the aim of the present invention to provide a new slide hopper multilayer coating method and apparatus which enable edge bead formation to be more easily avoided or reduced.

According to the present invention a slide hopper multilayer web coating method comprising feeding liquid coating composition through each of two or more mutually parallel delivery slots in an inclined surface on which the quantities of composition leaving the slots form downwardly moving layers which leave such surface, superimposed one on another, at a transverse terminal edge which is parallel with such slots, and pass onto a moving web, is characterised in that the width of the layer descending from the top slot is greater than the width of the other layer or at least one of the other layers and is not exceeded by the width of any such other layer.

The method according to the invention is suited for bead coating.

In bead coating, a bead of coating composition is formed between the terminal edge of the slide hopper and the free surface of a web that is moved closely spaced from the terminal edge. A pressure difference across the bead maintains a stable bead also at elevated coating speeds. Necking in with the resultant formation of edge beads occurs over the zone where the bead is freely supported in the air. Such edge beads are usually coated on the knurled marginal zones of the film, such as a film of cellulose triacetate or of polyethylene terephthalate, so that after the drying step the complete width of the film situated between the knurled edges may be used to be slit and cut into sheets, strips or small rolls of film.

Another cause for the formation of edge beads is situated in the hopper itself since it has been shown that, as a layer comes out from the delivery slot in the slide surface of the coating hopper, its edge portions may already be slightly thicker than the central portion of the layer. This phenomenon is magnified as the layer flows down the slide surface since due to the wetting contact of the edges of the layer with the edge guides on the slide surface, the edge portions of the layer have a tendency to further increase in thickness.

By observing the relative coating layer width condition according to the invention as above defined, the formation of edge beads is avoided or reduced. The amount by which the top layer width should exceed the width of at least the widest of any other layer, in order to achieve the best results in given circumstances, which of course include the materials of the surface to be coated and the coating materials, can be determined by simple tests. Generally, it is preferable for that amount to be such that the top layer projects laterally beyond each side edge of such other layer by at least 3 millimeters. There is then sufficient allowance for slight incidental layer width fluctuations to avoid difficult problems of accuracy control. Preferably the amount of the excess width of the top layer is from 4 to 10 millimeters. The excess width should of course not be greater than is necessary for achieving the required results because that would be wasteful of coating material.

Preferred embodiments of the method according to the invention incorporate one or more of the following features (a) to (c):

(a) The thickness of each layer of extra width is smaller than the thickness of each layer having the lesser width.

(b) The surface tension of the coating layer which directly contacts the web surface being coated is lower than the surface tension of that surface.

(c) The surface tension of each layer having the extra width is lower than the surface tension of each layer having the lesser width.

The web surface which is coated by the method according to the invention may be the surface of the actual supporting web, such as cellulose triacetate or polyethylene terephthalate, or it may and will more usually be the surface of a subbing layer, e.g. the top one of a plurality of subbing layers, previously applied to such a substrate in order to ensure or to improve adhesion of the layers applied by the slide hopper coating method.

The invention includes a device for coating a web with a plurality of layers, comprising a slide hopper having an inclined slide surface in which there is a plurality of mutually parallel delivery slots disposed at different levels and having supply channels via which separate quantities of coating composition can be supplied to such slots so as to form on said surface downwardly sliding layers which become superimposed one on another preparatory to flowing from such surface onto a moving web, characterised in that the length of the top slot is greater than the length of at least one of the other slots and is not exceeded by the length of any other slot.

In certain embodiments there are at least three of the slots and their lengths decrease from the top slot to the bottom slot.

The device may incorporate side edge guides on the slide surface, the distance between such guides, from the level of the top slot to a level at or near the bottom end of the slide surface, being equal to the length of the top slot. The distance between these side guides may increase near the bottom terminal edge of the slide surface.

The device may also comprise filling means near the lateral extremities of at least one of the supply channels of the hopper for limiting the effective length of that channel and its delivery slot. Said filling means may be arranged for adjustment of the corresponding delivery slot length.

Some examples of the invention will now be described with reference to the accompanying drawings, wherein.

Figure 1:
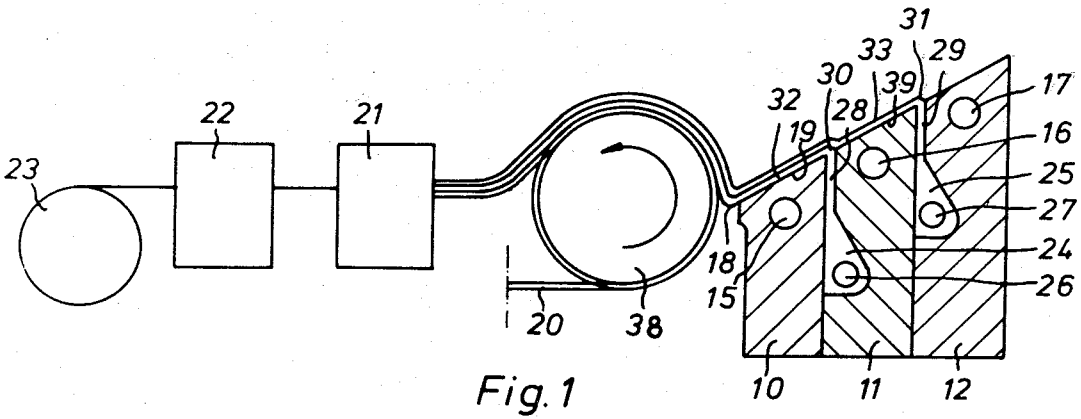
FIG. 1 is a diagrammatic cross-sectional view of a common dual layer slide hopper coater, together with two after-treatment stations.

Referring to FIG. 1, there is shown a slide hopper coater which was employed to simultaneously apply two individual, contiguous coatings to a travelling web for the production of photographic film.

The coating device is shown as comprising a plurality of individual blocks 10 to 12 which are suitably machined in order that they may be assembled to provide manifolds, channels, slots, etc. further detailed hereinafter.

Figure 3:
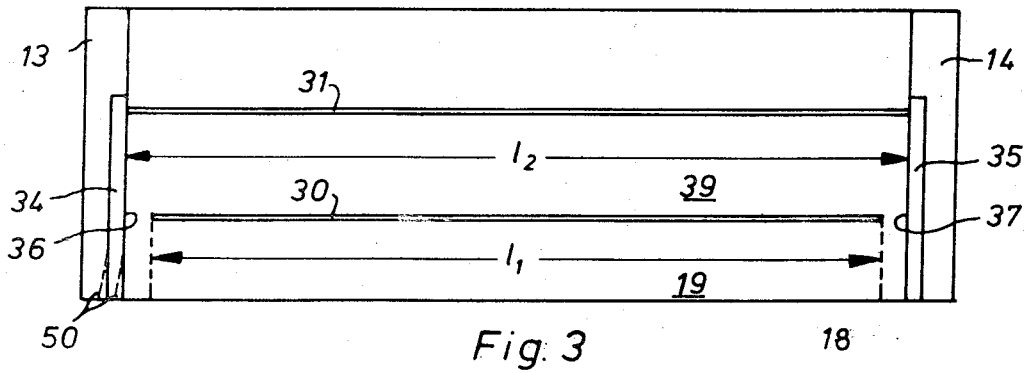
FIG. 3 is a top view of a slide hopper coater arranged according to the present invention.

Individual blocks 10 to 12 as well as the flanges 13 and 14, see FIG. 3, may be held in assembled relationship by appropriate fastening means known in the art.

Since the coating compositions employed are of the type which require maintenance of strict temperature parameters, the hopper may be provided with conduits such as 15 to 17, through which an appropriate heat exchange fluid medium, for example water, may be continuously circulated.

The hopper may be provided with any suitable form of adjustable mounting so that the position of the terminal edge 18 of the surface 19, relative to the web 20, may be adjusted for optimum coating results.

Subsequent to the coating step of the web 20, in the production of photographic film, it is necessary to set and/or dry the coatings applied thereto. In such case, web 20 after being coated may be passed through chill station 21 and/or through a drying chamber 22. The web may then be wound on a wind up roller 23.

The coating hopper possesses two distributing manifolds 24 and 25 which are fed on one lateral side of the hopper through openings such as the openings 26 and 27 illustrated. The manifolds communicate with narrow vertical feed channels 28 and 29 through which the liquid coating compositions are upwardly fed to delivery slots 30 and 31 from which they issue in the form of a ribbon onto the downwardly inclined surfaces 19 and 39, down which they flow by gravity in the form of layers 32 and 33, to terminal edge 18, and then onto the surface of the web 20.

Web 20 is backed up at the point of the layer deposition by a roller 38 which may serve as a means for continuously moving the web across, and in contact with, composite coating layers 32 and 33 and serves also as a means for supporting and holding the web in a smooth condition to take up of the contiguous coatings.

In the present embodiment, the surfaces 19 and 39 which together form the slide surface of the hopper are co-planar. These surfaces are so arranged that upon continuous extrusion of the respective coating compositions, the composition issuing from the delivery slot 31 flows layerwise down surface 39 up on top of the composition issuing from slot 30, and the two compositions flow then together down surface 19, and from the terminal edge 18 of the surface 19 onto the surface of the travelling web 20.

The surface 19 and 39 have lateral guide members 34 and 35, see FIG. 3, which are in fact rigid projections mounted adjacent opposite lateral edges of the delivery slots 30 and 31. The guide members have mutually facing surfaces 36 and 37, extending in the direction of flow of the coating composition perpendicular to the slide surfaces, to provide a cooperating channel extending in the direction of coating composition flow.

Figure 2:
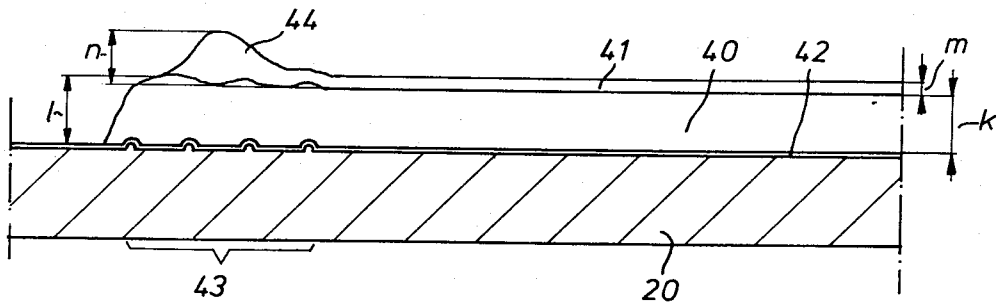
FIG. 2 is a transverse cross-sectional view on an enlarged scale of a marginal portion of a web onto which two layers have been coated by means of a conventional slide hopper coater.

Referring now to FIG. 2, an enlarged cross-sectional view is given of a web that has been coated with two layers produced by means of a conventional slide hopper coater, that is a coater having delivery slots of equal length. The first layer 40 is a relatively thick gelatineous layer of light-sensitive silver halide, whereas the second layer 41 is a relatively thin gelatineous anti-stress layer. It should be noted that the transversal cross-sectional views of FIG. 2, and FIG. 4 to be described hereinafter, are diagrammatic representations wherein the different thickness ratios do not purport to be exactly accurate. As a matter of fact, the thickness of the coated layers has been disproportionally exaggerated for the sake of clarity, at least as compared with the thickness of the support. The same is true for the edge knurlings of the marginal zones 43 of the support. For the same reason of clarity, the coated layers have not been cross-hatched in the drawings. The layer 42 is a subbing layer for improving the adhesion of the layer 40 to the web 20.

It may be seen that the layer 40 "follows" in some way the knurled surfaces of the edge knurled regions 43 of the web 20. Such edge knurling has been represented diagrammatically by four raised web surface projections, but it will be understood that such number of raised projections on a transverse section may vary widely. The thickness l near one lateral extremity of the layer 40 is slightly greater than the thickness k of said layer which is uniform over the width of the layer between the edge knurlings of the web.

It may further be seen that the behaviour of layer 41 is quite different since this layer, which was initially formed at a width equalling the width of the layer 40, has retracted laterally somewhat since under the influence of surface tension effects a beaded edge 44 has been formed. The thickness of that bead is indicated by n and it may be seen that thickness n may amount to a multiple of the thickness m of the portion of the layer which is comprised between the edge knurlings of the web.

Figure 4:
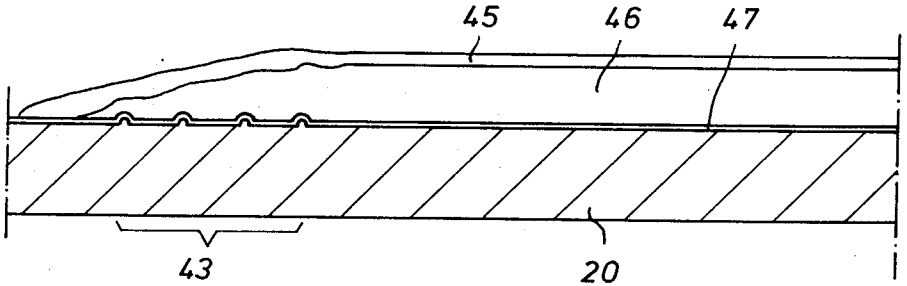
FIG. 4 is a transverse cross-sectional view on an enlarged scale of a marginal portion of a web onto which two layers have been coated by means of the coater according to FIG. 3.

FIG. 4 illustrates the consequences when according to the invention, the upper layer 45 is extruded at a width exceeding the width of the lower layer. It appears that the layer 45, which has a smaller surface tension than the layer 46 and than the subbing layer 47, pulls along, so to say, the lateral extremity of the layer 46, so that both layers 45 and 46 are feathered at their thin lateral extremities. In the illustration of FIG. 4 the mentioned difference in relative width has been obtained by using a coating hopper the upper delivery slot of which, had a length greater than the length of the delivery slot of the coating hopper that had been used for coating the material illustrated in FIG. 2. The dimension of each feed channel, measured parallel with the length of the corresponding delivery slot is again equal to the length of that slot.

The required difference between the slot length has in this particular coating hopper been obtained in a very simple way.

Initially, both channels and delivery slots of the coating head had a length exceeding the desired width of the layer to be extruded. During the assembling of the blocks 10, 11 and 12 of the coating hopper the marginal zones of the channels were filled up with a suitable material that forms a kind of end dam which limits at either side the actual width of the channels 28 and 29. In accordance with the prior art method of coating, end dams were used of equal width for both channels so that consequently the layers of coating composition extruded through the channels 28 and 29 and the corresponding slots 30 and 31 had equal widths.

For purposes of the invention, the end dams of the upper channel 29 were given a smaller width than the end dams of the lower channel 28 so that the slot 31 was correspondingly longer ($l_2$) than the slot 30 (length $l_1$). Details about this particular way of construction of the coating hopper will be set forth with reference to FIG. 5 after the description of the examples illustrating the invention.

The following Example 1 illustrates the use of a known method, with reference to FIG. 2 and Example 2 is a method according to the invention and makes reference to FIG. 4.

EXAMPLE 1 (Comparative)

A polyethylene terephthalate film of a width of 1728 mm and a thickness of 0.10 mm was provided with edge knurlings having a width of 10 mm and the outer edge of which was located at 10 mm from the corresponding edge of the film. The height of the raised portions of the edge knurling amounted to 10 μm. The film was provided with a subbing layer having a thickness of 0.6 μm after its drying and a surface tension $\gamma_s = 41$ mN.m$^{-1}$. A light-sensitive silver halide emulsion layer, used in the manufacturing of radiographic film, was coated through the delivery slot of the apparatus according to FIG. 1, the orifice 30 having a length $l_1$ of 1692 mm. The surface tension $\gamma_e$ of the emulsion layer was 31 mN.m$^{-1}$. An antistress gelatinous layer was coated through the orifice 31 having a length $l_2$ of 1692 mm. The surface tension $\gamma_a$ of the antistress layer was 29 mN.m$^{-1}$. During the coating of the layers, it could be observed that the layers, while on the slide surfaces, were slightly thickened at their lateral extremities. Attentive observation of the coating bead between the terminal edge 18 and the web surface showed that a serious necking-in of the layers occurred, when they were out of contact with the edge guides at the terminal edge 18. This reduction in width was the cause for a considerable increase of the size of the edge beads of the composite layers.

The respective thicknesses of the layers were as follows after drying (using the letters k to n to denote thickness measurements as indicated in FIG. 2): k=7.8 μm and l=10.8 μm; ratio$_1$ (l:k)=1.38:1 m=1.1 μm and n=1.4 μm; ratio$_2$ (n:m)=1.27:1

It may be seen that the combined thickness ratio, namely ratio$_1$×ratio$_2$ amounts to 1.76:1 so that the drying time for the edge beads thus formed amounts to at least 1.7 times the drying time of the central portion of the layers having a uniform thickness.

It will further be understood that this increased thickness of the edge beads involved the consequence that successive windings of the roll of dried film no longer bear on the knurled edge portions of the film but, on the contrary, are supported on the edge beads of the coated layers. The effect of the edge beads was clearly visible by the naked eye if one looked at a roll of a length of 600 meters wound upon a core of 300 mm diameter. The roll showed two distinct edge beads at its periphery and these edge beads were raised by approximately 2 mm above the outer extreme edge of the roll. Additionally, the mentioned roll of film was not "straight" from one edge to the other but its central portion was rather sagged to a slight extent, as compared with the end portions. Finally, manipulation of the mentioned roller had to be carried out with extreme care in order to avoid telescoping deformation of the roller.

EXAMPLE 2

A polyethylene terephthalate film of a width of 1728 mm and a thickness of 0.10 mm was provided with edge knurlings having a width of 10 mm and the outer edge of which was located at 10 mm from the corresponding edge of the film. The height of the raised portions of the edge knurling amounted to 10 μm. The film was provided with a subbing layer having a dry thickness of 0.6 μm and a surface tension of 41 $mN.m^{-1}$. A light-sensitive silver halide emulsion layer, used in the manufacturing of radiographic film, was coated through the orifice 30 having a length $l_1$ of 1692 mm. The surface tension $\gamma_e$ of the emulsion layer was 31 $mN.m^{-1}$. An antistress gelatinous layer was coated through the orifice 31 having a length $l_2$ of 1698 mm. The surface tension $\gamma_a$ of the antistress layer was 29 $mN.m^{-1}$. During the coating of the layers, it could be observed that the top coating layer 45, while on the slide surface, was slightly thickened at its lateral edges. Such thickening did not increase as that layer became supported on the lower coating layer 46. Furthermore it could be observed that the relatively thick lower layer 46 had no tendency at all to form edge beads since its edges were completely covered by and smoothed out by the superimposed, wider layer 45. Observation of the coating bead between the terminal edge of the slide surface and the web surface showed that there was no necking-in of the layers. On the contrary, the width of the coated part of the web was slightly, that is from 2 to 6 mm, greater than the width of the top layer 45 measured at the moment it moved out of contact with said terminal edge of the coating hopper.

A cross-section of the coated film is shown in FIG. 4 and it may be seen that any tendency for edge bead formation has disappeared. On the contrary, the relatively thin antistress layer 45 that is now coated at a width slightly in excess of the width of the relatively thick silver halide emulsion layer 46, flows out gradually in a decreasing thickness near the edges of the film and takes, so to say, the thicker layer 46 along so that said layer 46 similarly gets a gradually decreasing thickness in the direction towards the edges of the film. As result thereof, upon drying of the film, the marginal portions of the film get dried at the same moment, or even earlier, than does the central, substantial portion of the film. Furthermore, in the absence of edge beads, the film convolutions firmly bear on the knurled edge portions, which is specifically the object of the film edge knurling. A roll of wound film showed an absolutely flat and stiff marginal zone what pointed to a perfect bearing of the successive convolutions of the film roll on the knurled edges.

During the coating in accordance with the two examples, edge guides 34 and 35 were provided on the slide surfaces of the hopper, the width between the opposite surfaces 36 and 37 of which amounted to 1698 mm.

The following two examples illustrate the coating method according to the invention for the coating of more than two layers.

EXAMPLE 3

A three layer coating was made on a polyethylene terephthalate support of a thickness of 0.1 mm for the production of a light-sensitive photographic material that is rapidly developable according to the so-called stabilization process. The support was provided with a subbing layer having a thickness of 0.6 μm after its drying and a surface tension $\gamma_s$=41 $mN.m^{-1}$.

The bottom layer was an aqueous gelatin composition. The layer had a wet thickness of 35 μm and a dry thickness of 5μ, and was coated at a width of 1692 mm. The surface tension amounted to 34 $mN.m^{-1}$. The function of this layer is to form a water-permeable layer between the support and the silver halide emulsion layer whereby a rapid transfer of the developing agent through the silver halide emulsion layer is obtained upon processing.

The middle layer was an aqueous silver halide composition. The layer had a wet thickness of 30 μm and a dry thickness of 6 μm, and was coated at a width of 1692 mm. The surface tension was 32 $mN.m^{-1}$.

The top layer was a gelatin antistress layer. The layer had a wet thickness of 30 μm and a dry thickness of 1 μm. The surface tension amounted to 28 $mN.m^{-1}$. The layer was coated at a width of 1698 mm. The photographic material manufactured as described above, showed a uniform thickness profile according to its width. When the material was made with the three layers having equal widths, it was found that very pronounced beaded edges were produced.

EXAMPLE 4

A four layer coating was made on a triacetate support of a thickness of 140 μm, for the production of a light-sensitive positive-type cine material. The support was provided with a subbing layer with a surface tension $\gamma_s$=42 $mN.m^{-1}$.

The bottom layer was a blue sensitive silver halide composition with a wet thickness of 35 μm, a dry thickness of 4 μm, and a surface tension of 37 $mN.m^{-1}$. The layer was coated at a width of 1110 mm.

The next layer was a red sensitive silver halide composition with a wet thickness of 30 μm, a dry thickness of 4.5 μm, and a surface tension of 34 $mN.m^{-1}$. The layer was coated at a width of 1110 mm.

The next layer was a green sensitive silver halide composition with a wet thickness of 30 μm, a dry thickness of 5 μm, and a surface tension of 33 $mN.m^{-1}$. The layer was coated at a width of 1115 mm.

The top layer was an antistress gelatineous composition, and had a wet thickness of 20 μm and a dry thickness of 1 μm. The surface tension amounted to 28 $mN.m^{-1}$. The layer was coated at a width of 1119 mm. The photographic material manufactured as described hereinbefore showed a satisfactory thickness profile according to its width. If the four layers were coated at equal widths, beaded edges were formed that had adverse consequences on the drying of the material. Furthermore, a roll of wound material was extremely liable to telescoping deformation.

As mentioned hereinbefore, further details with respect to one embodiment for producing a slide hopper coater with two coating slots of different length, are now described with reference to FIG. 5.

Figure 5:
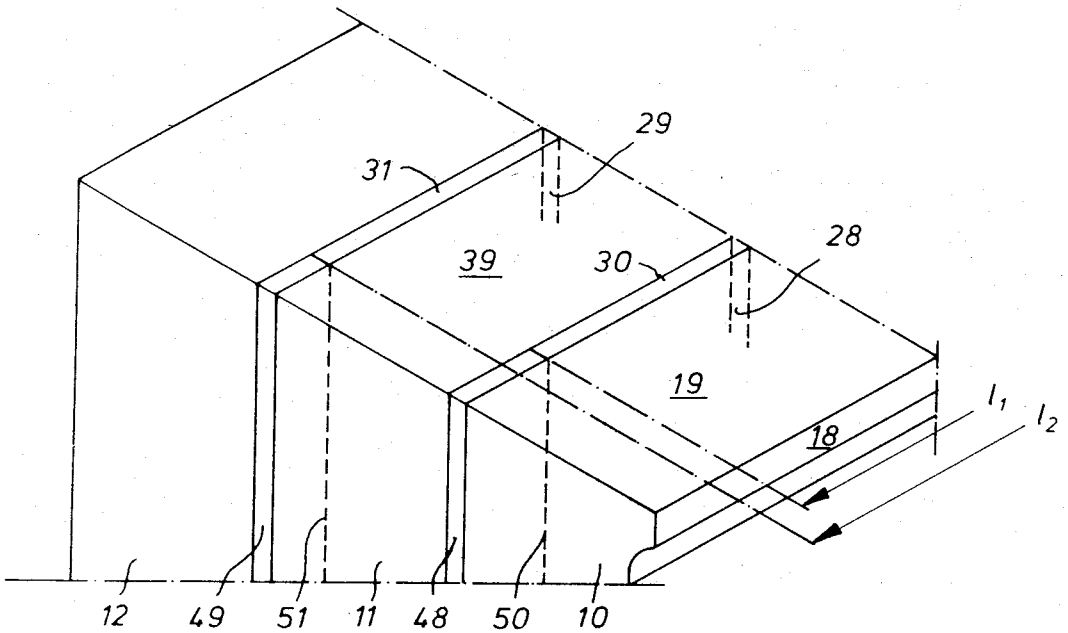
FIG. 5 is a perspective partial view of the slide hopper according to FIG. 3.

Referring to FIG. 5 which is a perspective, partial view of the two layer slide hopper according to FIGS. 1 and 3, it may be seen that the channels 28 and 29 between the respective stainless steel blocks 10, 11 and 12 are closed near their lateral extremities (only the lefthand extremity illustrated) by filler strips 48 and 49. These strips were made in the present case by means of a paste of a two component synthetic rubber that was applied on one face of each channel 28, 29 before the elements 10 to 12 were assembled. Assembling of the elements, the opposite faces of the channels being coated with a release agent, made the rubber paste become spread out. After curing of the rubber paste, the hopper was dismantled, and the rubber that adhered to the said one faces was cut on the lines 50 and 51 to obtain the respective widths $l_1$ and $l_2$. The rubber within the boundaries of $l_1$ and $l_2$ was removed so that finally rectangular strips 48 and 49 remained. Then the slide hopper was reassembled and ready for use.

The present invention is not limited to the described embodiments and examples.

The method and the device according to the present invention are suitable for coating more than four layers. As known in the art, cascade coating may be used for the application of 5 to 7 or more layers at a time and the present invention may be used successfully too for the coating of such greater number of layers. The width of the top layer only may be greater than the width of the other layers, but the top layer and one or more contiguous layers may also be wider than the other, lower, layers, in order to get the desired result.

The method and the device according to the present invention are also suitable for coating two or more layers of the same composition as is sometimes done in the coating art for building up a layer which cannot properly be formed from one extruded stratum.

Furthermore, the wider layers need not necessarily be contiguous and thus it is possible for example making the first (top) and third layers of a seven layer coating of a width greater than the width of the second and each of the fourth to seventh layers.

The decrease in width from the upper towards the lower layer may occur progressively and thus a stepwise reduction in corresponding widths of the distinct extruded layers may be used.

The thickness of a layer of greater width must not necessarily be less than the thickness of the contiguous lower layer of smaller width but it may also be equal thereto.

The surface tension of each layer of great width should preferably be smaller than the surface tension of the substrate (i.e. the web or a pre-formed subbing layer) which will be coated thereby. Preferably the surface tension of a wider layer is also less than the surface tension of the contiguous less wide layer with which it comes into contact.

The method and device according to the invention are not limited to the coating of light-sensitive, antistress and other photographic layers but it may also be used in the coating of subbing layers and the like. For instance, in the coating of polyethylene terephthalate with a subbing layer, it is known that in some cases such subbing layer has to be composed of two chemically different layers in order to obtain a sufficient bond between the subbing layer and the support on the one side, and between the subbing layer and a super-imposed photographic emulsion layer on the other side.

A further measure that may be helpful in the avoidance of edge beads is the divergence of the guide surfaces of the edge guides of the slide hopper. This has been diagrammatically illustrated in FIG. 3 for the edge guide 34, the lower portion of which has been given an outwardly diverging direction as illustrated in broken lines 50 for said guide 34. The same holds for the opposite edge guide. In the mentioned way, a tension is exerted in the transverse direction on the downwardly flowing layers, whereby beaded edges may be further reduced in size or even completely eliminated.

Finally it will be understood that a multiple layer slide hopper coated need not be constructed as described hereinbefore in order to obtain delivery slots of different lengths. The machining of the different blocks may be such that without further treatment the channels and the delivery slots have the correct end dimensions. Alternatively, means may be devised for continuously adjusting the length of the channels and the slots during the operation of the coater.

We claim:

1. A slide hopper multilayer web coating method comprising feeding liquid coating composition through each of at least two mutually parallel delivery slots formed in an inclined surface on which the quantities of composition emerging from the slots form downwardly moving layers which leave such inclined surface, superimposed one on another, at a transverse terminal edge thereof which is parallel with such slots, and pass onto a web moving generally perpendicularly to the width of said slots, wherein the width of the layer issuing from the top slot is greater than the width of at least one other layer and is not exceeded by the width of any other layer and the width of the web is at least as great as the width of the widest of the slots.

2. Method according to claim 1, wherein the thickness of each layer of greater width is smaller than the thickness of each layer of smaller width.

3. Method according to claim 1, wherein the surface tension of the layer issuing from the top slot is smaller than the surface tension of the web surface with which said layer enters into contact.

4. Method according to claim 1, wherein the surface tension of each layer of greater width is lower than the surface tension of each layer of smaller width.

5. Method according to claim 1, which method is a bead coating method.

6. In a bead coating apparatus for coating a web with a plurality of layers, comprising a slide hopper having an inclined slide surface terminating in a lower edge, which surface at different levels therealong is penetrated by a plurality of mutually parallel delivery slots, and corresponding supply channels for supplying separate quantities of coating composition to such slots so as to form on said surface downwardly flowing layers which become superimposed one on another before reaching said lower edge of such surface, a web guide roll having its axis disposed generally parallel to said lower slide surface edge with its peripheral surface proximate to said edge and intersected by a plane passing through said slide surface, and means for advancing a length of web to be coated around a portion of the roll periphery adjacent said edge with the exposed web surface moving in closely spaced relation to said edge to become coated with said superposed layers of composition removed from a bead thereof formed along said lower surface edge, the improvement wherein the length of the uppermost of said plurality of slots is greater than the length of at least one other slot and is not exceeded by the length of any other slot and the width of the web is at least as great as the widest slot.

7. Apparatus according to claim 6, wherein there is at least three of said slots and their widths decrease from the top slot to the bottom slot.

8. Apparatus according to claim 6, comprising side edge guides on said inclined slide surface, the distance between such guides, from the level of the top slot to a level at least near the lower edge of the slide surface being generally equal to the length of the top slot.

9. Apparatus according to claim 6, comprising edge guides on the slide surface, the distance between the guide surfaces of which increases in the direction of the lower end thereof.

10. Apparatus according to claim 6, including filling means adjacent the lateral extremities of at least one of the supply channels of the hopper for limiting the effective length of said channel and its delivery slot.

* * * * *